US006848240B2

(12) United States Patent
Frey

(10) Patent No.: US 6,848,240 B2
(45) Date of Patent: Feb. 1, 2005

(54) STRETCH HEAD FOR FACILITATING WRAPPING PALLETIZED LOADS

(75) Inventor: Michael R. Frey, Coral Springs, FL (US)

(73) Assignee: Illinois Tool Works Inc., Glenview, IL (US)

( * ) Notice: Subject to any disclaimer, the term of this patent is extended or adjusted under 35 U.S.C. 154(b) by 88 days.

(21) Appl. No.: 10/025,667

(22) Filed: Dec. 26, 2001

(65) Prior Publication Data

US 2003/0115840 A1 Jun. 26, 2003

(51) Int. Cl.[7] ..... B65B 53/00
(52) U.S. Cl. ..... 53/556
(58) Field of Search ..... 53/52, 505, 556, 53/211, 389.2, 389.3, 587, 588; 242/417.3

(56) References Cited

U.S. PATENT DOCUMENTS 3,763,701 A * 10/1973 Wright et al. ..... 73/862.474
4,173,108 A * 11/1979 Eglinton et al. ..... 53/587
4,302,920 A 12/1981 Lancaster et al.
4,497,159 A 2/1985 Lancaster
4,869,029 A * 9/1989 Takatani et al. ..... 53/52
4,914,891 A 4/1990 Suolahti
5,050,367 A * 9/1991 Heisler ..... 53/72
5,414,979 A 5/1995 Moore et al.
5,447,008 A 9/1995 Martin-Cocher
5,477,658 A 12/1995 Berger et al.
5,596,864 A * 1/1997 Reeves ..... 53/399
5,603,198 A * 2/1997 Rimondi et al. ..... 53/441
5,765,344 A * 6/1998 Mandeville et al. ..... 53/441
5,768,862 A * 6/1998 Mauro ..... 53/556
5,797,240 A * 8/1998 Martin-Cocher et al. ..... 53/399
5,862,647 A 1/1999 Scherer et al.
6,185,914 B1 * 2/2001 Mackie ..... 53/556
6,293,074 B1 * 9/2001 Lancaster et al. ..... 53/399
6,393,808 B1 * 5/2002 Kallner et al. ..... 53/556
6,470,657 B2 * 10/2002 Huson et al. ..... 53/588

* cited by examiner

*Primary Examiner*—Rinaldi I. Rada
*Assistant Examiner*—John Paraddiso
(74) *Attorney, Agent, or Firm*—Schwartz & Weinrieb

(57) ABSTRACT

A stretch head for facilitating the wrapping of palletized loads within packaging or wrapping film comprises a vertical downright, and a carriage assembly vertically movable along the vertical downright. A base plate is mounted upon the carriage assembly and is inclined with respect to a horizontal plane so as to have a first end thereof disposed at a higher elevation than a second opposite end thereof. A supply roll of wrapping or packaging film is rotatably mounted upon the first higher end of the base plate, and a pair of tension rollers are mounted upon a substantially central portion of the base plate. A strain gauge roller is also mounted upon the base plate for receiving the wrapping film exiting from the tension rollers, a first idler roller is mounted upon the base plate for receiving the wrapping film from the strain gauge roller, and a second idler roller is mounted upon the second opposite end of the base plate for receiving the wrapping film from the first idler roller. Since the second idler roller is mounted upon the lowest end portion of the base plate, in view of the inclined disposition thereof, the second idler roller is capable of positioning the wrapping film at the lowest elevation whereby the wrapping film can be wrapped around the lowermost regions of the palletized load. The second idler roller also comprises a rubberized sleeve member for preventing movement of the wrapping film in an axial direction along the external periphery of the second idler roller so as to ensure proper positioning and orientation of the wrapping film with respect to the palletized load.

10 Claims, 3 Drawing Sheets

STRETCH HEAD FOR FACILITATING WRAPPING PALLETIZED LOADS

FIELD OF THE INVENTION

The present invention relates generally to stretch film wrapping machines, and more particularly to a new and improved wrapping machine stretch head wherein the stretch head is provided with a belted or sleeved control roller which permits the film wrapping material being dispensed from a supply roll of film wrapping material to be positionally controlled and, in particular, to enable the dispensed film to be capable of being applied to a palletized load at an elevational level which is within a predetermined distance from the bottom of the pallet or above the support surface upon which the pallet is supported.

BACKGROUND OF THE INVENTION

Film wrapping machines for wrapping products, articles, packages, or the like, in wrapping film conventionally comprise a film roll upon which a supply of the wrapping film is disposed, and a plurality of rollers around which the wrapping film is routed so as to have a predetermined amount of tension developed within the film such that the wrapping film exhibits a predetermined or requisite amount of tension required for the film wrapping operation. It was noted within U.S. Pat. No. 5,862,647, which issued to Scherer et al. on Jan. 26, 1999, that one type of film wrapping stretch head conventionally comprises a set of rollers having upper and lower end portions thereof respectively mounted within upper and lower frame members whereby, in order to route the wrapping film from the film supply roll, through the various tensioning and idler rollers, and to the palletized load, such as, for example, during a film supply roll exchange or replenishment operation of a new or fresh film supply roll for a depleted film supply roll, a leading end of the wrapping film must be withdrawn from the film supply roll and manually routed or threaded through and around the set of tension rollers.

It was further noted that this process was awkward, difficult, tedious, and time-consuming to perform by operator personnel because the film must be threaded or routed beneath the upper frame member and between the tension rollers, It was noted still further that in order to improve upon the aforenoted stretch head and its film threading system, other stretch head systems have been disclosed, for example, within U.S. Pat. No. 4,914,891which issued to Suolahti on Apr. 10, 1990, as well as within U.S. Pat. No. 5,414,979 which issued to Moore et al. on May 16, 1995, whereby the various rollers are mounted in an interdigitated manner upon frame members which are movably mounted in a pivotal manner with respect to each other between, in effect, OPENED and CLOSED positions. While such pivotal frame stretch head systems therefore rendered the film threading or routing process easier to perform, the film threading or routing process attendant such stretch head systems were nevertheless time-consuming and therefore resulted in a significant amount of operational downtime attendant a film roll replacement, exchange, or replenishment operation.

In order to therefore improve still further upon the PRIOR ART systems, the stretch head system disclosed within the aforenoted U.S. Pat. No. 5,862,647 which issued to Scherer et al. on Jan. 26, 1999, was developed wherein, in effect, the upper frame member of the stretch head was effectively eliminated such that the wrapping film routing or threading operation could be readily and easily accomplished in a relatively simple manner by enabling the insertion of the wrapping film, into the spaces defined between the tension rollers, in an axial direction parallel to the axes of the tension rollers. More particularly, the operating or driving system for the stretch rollers or tension rolls is provided within a first end or bottom region of the stretch head, and second or upper ends of the tension rolls or stretch rollers are mounted or secured within independent support or mounting brackets. In this manner, the second ends of the tension rolls or stretch rollers are not connected to each other, the second ends of the tension rolls or stretch rollers are spaced from each other so as to permit the wrapping film to be threaded or routed therebetween, and the second end of the stretch head is effectively open so as to permit the wrapping film to be easily, quickly, and simply inserted in an axial mode between the tension rolls or stretch rollers. As a result, the awkward, difficult, and tedious threading or routing of the wrapping film beneath the upper frame member and between the stretch rollers or tension rolls, in a direction which is substantially transverse to the longitudinal axes of the stretch rollers or tension rolls, is effectively obviated. In addition, the structure and relative arrangement of the operative components of such a stretch head effectively eliminated the need for mounting the tension rolls or stretch rollers upon frame members which were pivotally movable between CLOSED and OPENED positions in order to effect, for example, a supply film roll exchange, replacement, or replenishment operation.

While the aforenoted improved stretch head has met operational specifications and expectations in that, for example, the insertion or routing of the wrapping film between the tension rolls or stretch rollers has in fact been rendered easier, quicker, and simpler to perform and achieve, and therefore, the improved stretch head has in fact been commercially successful, it has been experienced that in connection with, for example, the wrapping of palletized loads, it is not always possible to dispose the leading or free end portion of the wrapping film at a proper or predetermined angular position, and at an elevational level, with respect to the palletized load so as to enable the wrapping film to effectively be disposed around the lowermost regions of the palletized load. This wrapping technique of the wrapping film with respect to the palletized load is critically important in that when the wrapping film is able to be wrapped around the lowermost regions of the palletized loads, whereby in effect, the wrapping film is in fact wrapped around the lowermost extent of the palletized load per se as well as partially around the support pallet, then the palletized load will in fact be able to be properly fixedly secured upon the support pallet. Still further, it is also important that the final roller component, around which the wrapping film is routed and which is located just upstream from the palletized load as considered in the dispensing direction of the wrapping film from the supply film roll toward the palletized load, can properly secure and control the disposition or orientation of the wrapping film such that the wrapping film is in fact dispensed toward the palletized load at a proper or predetermined disposition or orientation whereby the wrapping film will be properly wrapped upon the palletized load in order to ensure the fixation of the load upon the support pallet in a stabilized manner.

A need therefore exists in the art for a new and improved stretch head wherein the leading or free end portion of the wrapping film can be disposed at a proper or predetermined angular position, and at an elevational level, with respect to the palletized load so as to enable the wrapping film to effectively be disposed around the lowermost regions of the palletized load, and wherein the disposition or orientation of the wrapping film can be positioned or controlled with respect to the stretch head such that the wrapping film can be dispensed toward the palletized load at a proper or predetermined disposition or orientation whereby the wrapping film can in fact be properly wrapped upon the palletized load so as to ensure proper and secure fixation of the palletized load upon the support pallet in a stabilized manner.

OBJECTS OF THE INVENTION

Accordingly, it is an object of the present invention to provide a new and improved wrapping film stretch head.

Another object of the present invention is to provide a new and improved wrapping film stretch head which effectively overcomes the various operational drawbacks and disadvantages characteristic of the PRIOR ART stretch heads or film wrapping systems.

An additional object of the present invention is to provide a new and improved wrapping film stretch head which enables the threading or routing of the wrapping film, with respect to the tension rolls or stretch rollers, to be easily, readily, and simply accomplished.

A further object of the present invention is to provide a new and improved wrapping film stretch head which enables the threading or routing of the wrapping film, with respect to the tension rolls or stretch rollers, to be easily, readily, and simply accomplished, and in addition, enables the wrapping film to be wrapped around the lowermost regions of the palletized load.

A last object of the present invention is to provide a new and improved wrapping film stretch head which enables the threading or routing of the wrapping film, with respect to the tension rolls or stretch rollers, to be easily, readily, and simply accomplished, which enables the wrapping film to be wrapped around the lowermost regions of the palletized load, and which can properly secure and control the disposition or orientation of the wrapping film at its position immediately upstream of the palletized load such that the wrapping film can be dispensed toward the palletized load at a proper or predetermined disposition or orientation whereby the wrapping film can in fact be properly wrapped upon the palletized load so as to ensure proper and secure fixation of the palletized load upon the support pallet in a stabilized manner.

SUMMARY OF THE INVENTION

The foregoing and other objectives are achieved in accordance with the teachings and principles of the present invention through the provision of a new and improved wrapping film stretch head which comprises a support frame, upon which the stretch head is mounted, wherein the support frame is mounted at a predeterminedly inclined angle upon a vertically oriented downright or mast-type support structure. A wrapping film supply roll is mounted upon a first end of the stretch head, while a discharge or dispensing idler roller is mounted upon a second opposite end of the stretch head whereby, due to the aforenoted inclination of the support frame with respect to the vertically oriented downright or mast-type support structure, the dispensing idler roller is located at a lower elevational position than that of the wrapping film supply roll. In accordance with the improvement of the present invention, an additional belted or sleeved roller is mounted upon the stretch head, at a position downstream from the dispensing idler roller and by means of an elongated mounting bracket, such that the belted or sleeved roller is disposed at an elevational level which is lower than that of the dispensing idler roller. In addition, the provision of the belted sleeve upon the belted or sleeved roller causes the wrapping film to effectively adhere to the belted sleeve material whereby, while the wrapping film can longitudinally traverse the belted sleeve, it cannot readily move, or experience slippage, with respect to the belted sleeve in a transverse direction. Therefore, the wrapping film can be dispensed toward the lowermost regions of the palletized load and can be positioned or located precisely as desired in order to be wrapped around predetermined regions or locations of the palletized load so as to ensure the secure fixation of the palletized load upon the support pallet.

BRIEF DESCRIPTION OF THE DRAWINGS

Various other objects, features, and attendant advantages of the present invention will be more fully appreciated from the following detailed description when considered in connection with the accompanying drawings in which like reference characters designate like or corresponding parts throughout the several views, and wherein.

DETAILED DESCRIPTION OF THE PREFERRED EMBODIMENT

Figure 1:
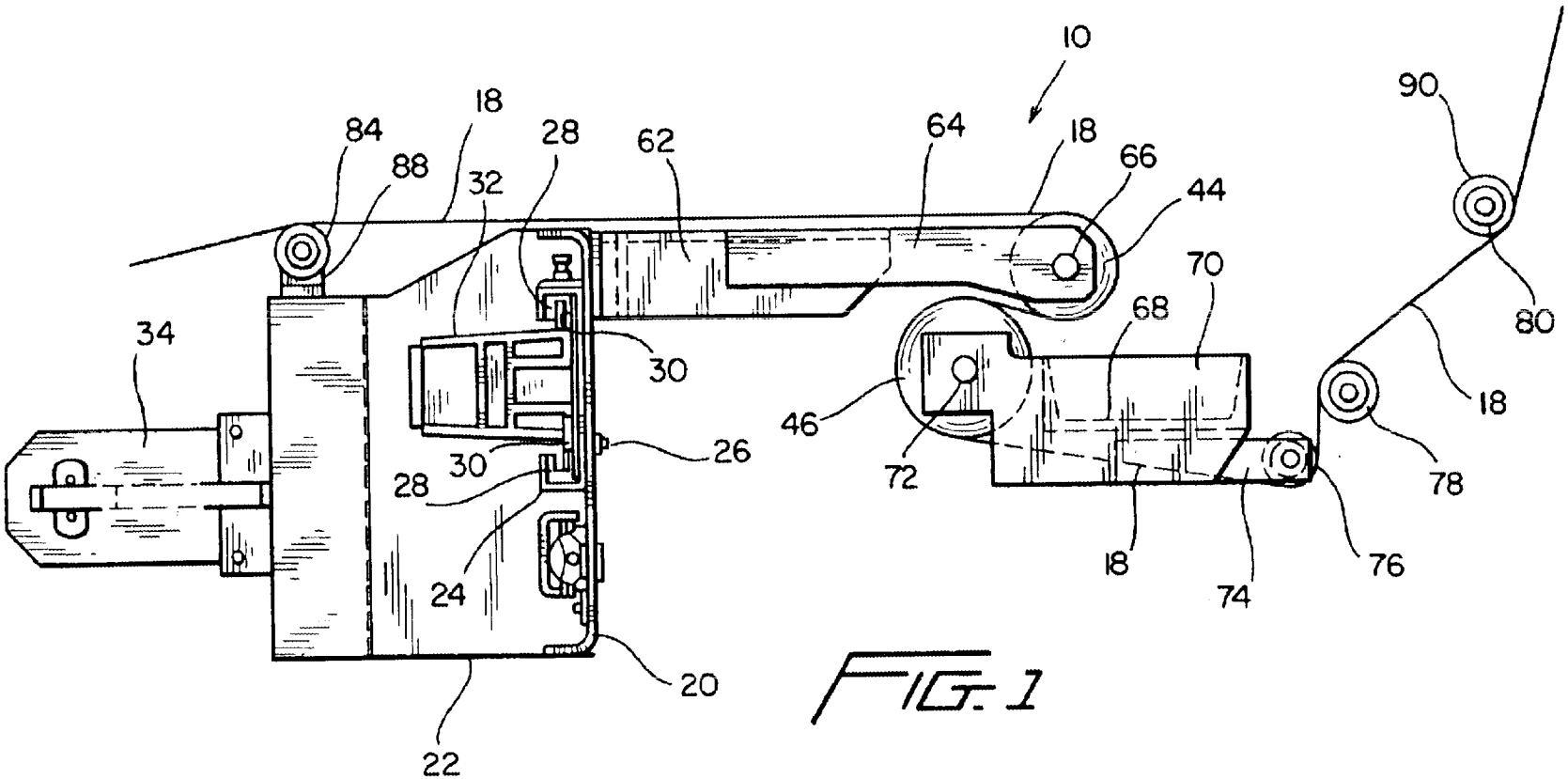
FIG. 1 is a partial top plan view of a new and improved wrapping machine stretch head constructed in accordance with the principles and teachings of the present invention and showing the cooperative parts thereof.
Figure 2:
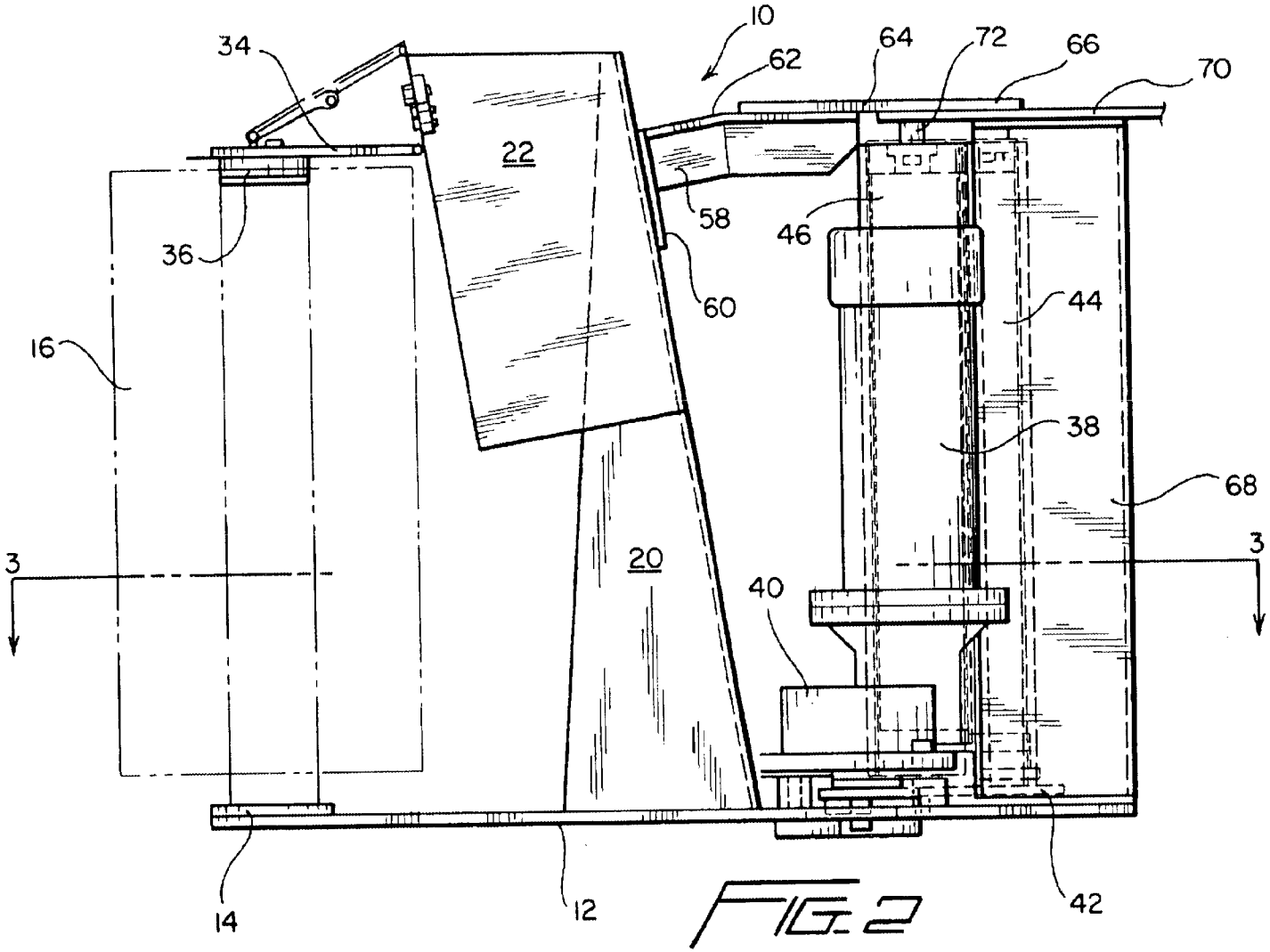
FIG. 2 is a side elevational view of the new and improved wrapping machine stretch head of the present invention and substantially corresponding to the stretch head disclosed within FIG. 1.
Figure 3:
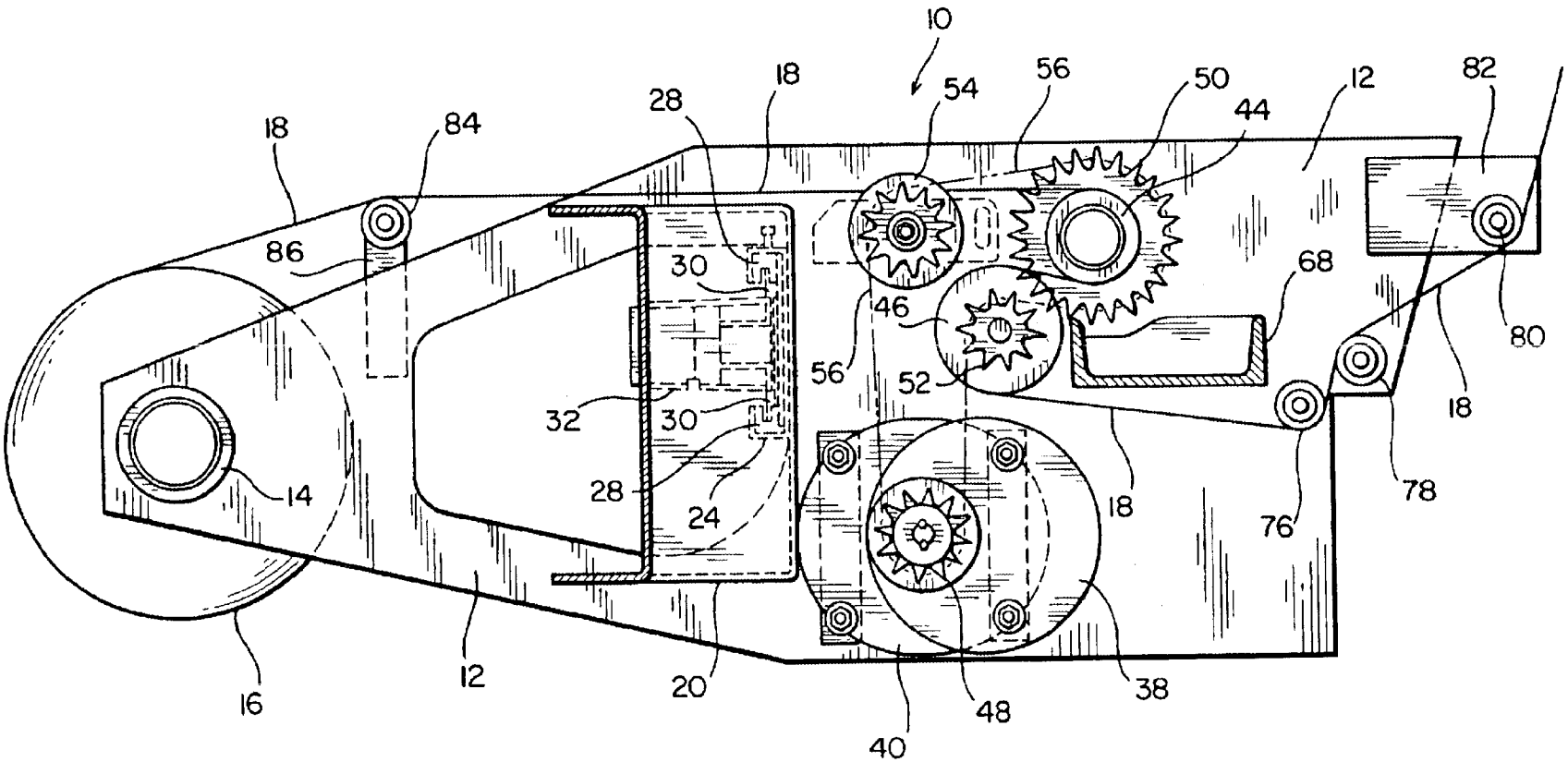
FIG. 3 is a cross-sectional view of the new and improved wrapping machine stretch head as shown in FIG. 2 as taken along lines 3—3 of FIG. 2.

Referring now to the drawings, and more particularly to FIGS. 1–3 thereof, the new and improved wrapping machine stretch head, constructed in accordance with the principles and teachings of the present invention, is disclosed and is generally indicated by the reference character 10. The stretch head 10 is seen to comprise a base plate 12, as best seen in FIGS. 2 and 3, upon one end of which a lower bearing member 14 is mounted so as to rotatably support a substantially upstanding or vertically oriented wrapping film supply roll 16 from which a fresh supply of wrapping film 18 is able to be withdrawn in connection with the performance of, for example, a palletized load wrapping operation comprising a palletized load disposed upon a support pallet, not shown. A substantially upstanding or vertically oriented main support frame 20 projects upwardly from a substantially central portion of the base plate 12, and a steel sheet housing 22 is integrally fixed to and carried by the main support frame 20. A support bracket 24, as best seen in FIG. 1, having a substantially reversely or backwardly oriented C-shaped configuration, is affixed to the main support frame 20 by suitable means, such as, for example, bolt fasteners 26, and the opposite ends of the support bracket 24 form, in effect, slotted rails 28 which are adapted to accommodate flanged ends 30 of a vertically oriented downright or support mast structure 32 upon which the entire wrapping machine stretch head 10 is vertically reciprocable attendant a film wrapping operation. It is seen further that the steel sheet housing 22 is provided with an upper support bracket 34 having an upper bearing member 36 mounted thereon for engaging the upper end of the wrapping film supply roll 16 so as to operatively cooperate with the lower bearing member 14 for rotatably supporting the wrapping film supply roll 16.

As may again be best appreciated from FIGS. 2 and 3, the opposite end of the base plate 12 of the stretch head 10 has a substantially vertically oriented drive motor 38 mounted thereon, as well as a gear box 40, and the drive motor 38 and gear box 40 are drivingly connected together by means of suitable gearing 42. At the rear of the base plate 12, there is provided a first tension roll or stretch roller 44 which extends substantially vertically upwardly from the base plate 12 and which has a relatively small diametrical extent, and there is also provided a second stretch roller or tension roll 46 which likewise extends substantially vertically upwardly from the base plate 12 and which has a relatively large diametrical extent. The gear box 40 is provided at its base with a suitable output gear or sprocket wheel 48, as best seen in FIG. 3, and the first, relatively small tension roll or stretch roller 44 and the second, relatively large tension roll or stretch roller 46 are respectively provided at their base ends with relatively large and small sprocket gears or wheels 50 and 52. An idler gear or sprocket wheel 54 is also mounted upon the base plate 12, and an endless sprocket chain 56 is routed around the gear box sprocket wheel 48, the tension roll or stretch roller sprocket wheels 50,52, and the idler sprocket wheel 54 such that rotary drive is transmitted from the motor 38 to the gear box 40 and, in turn, from the gear box 40 to the idler gear or sprocket wheel 54 and the tension roll or stretch roller sprocket wheels or gears 50,52 so as to rotatably drive the tension rolls or stretch rollers 44,46.

As can be further appreciated from FIG. 3, the wrapping film 18 from the wrapping film supply roll 16 is routed around the exterior surfaces of the tension rolls or stretch rollers 44 and 46 in a pattern having a substantially reversed or backwards S-shaped configuration, and in view of the relative difference between the diametrical extents of the tension rolls or stretch rollers 44,46, and their associated sprocket wheels or gears 50,52, the wrapping film 18 is stretched to a predeterminedly desired degree. In order to fixedly amount or secure the upper ends of the tension rolls or stretch rollers 44,46 with respect to or upon the stretch head 10, an angle iron 58 is provided within the upper region of the stretch head 10 and is seen to comprise a first leg portion 60 which is adapted to be fixedly secured to the main support frame 20 by suitable means, such as, for example, bolt fasteners, not shown, and a second leg portion 62 integral with the first leg portion 60 and to which one end of a first support bracket 64 is secured by suitable means, such as, for example, bolt fasteners, also not shown. The opposite end of the support bracket 64 is provided with a suitable rotary bearing 66 within or by means of which the upper end of the small tension roll or stretch roller 44 is rotatably mounted, all as best appreciated from FIG. 2.

In a somewhat similar manner, and as may be specifically appreciated from FIGS. 1 and 3, a substantially vertical upstanding frame or beam member 68, having a substantially C-shaped cross-sectional configuration, is fixedly secured at its lower end to the base plate 12, and the upper end of the frame or beam member 68 has a second support bracket 70 fixedly secured thereto as best seen in FIG. 1. One end of the second support bracket 70 is provided with a rotary bearing member 72 for rotatably supporting the upper end of the large tension roll or stretch roller 46, while an opposite end portion of the second support bracket 70 has a third support bracket 74 fixedly connected to an underside portion thereof by suitable means, such as, for example, bolt fasteners, not shown. The free end portion of the third support bracket 74 is attached to the upper end of a strain gauge roller 76 which is operatively connected to the motor 38 for controlling the operation of the motor 38 in accordance with the degree of tension characteristic of the withdrawn wrapping film 18 disposed about and sensed by the strain gauge roller 76 as the wrapping film 18 is conducted toward the wrapping station, not shown, at which the palletized load, also not shown, is disposed in preparation for being wrapped within the wrapping film. A first, substantially vertically oriented outfeed idler roller 78 is likewise mounted upon the base plate 12, and it is noted that the first outfeed idler roller 78 is located at a position which is adjacent to the strain gauge roller 76 such that the flow path of the wrapping film 18 is effectively routed around the outside portion of the strain gauge roller 76 and around the inside portion of the first outfeed idler roller 78. In this manner, the outfeed flow path of the wrapping film 18 from the strain gauge roller 76 toward the first outfeed idler roller 78 is effectively disposed at a predetermined angle, such as, for example, 90°, with respect to the infeed flow path of the wrapping film 18 from the large tension roll or stretch roller 46 toward the strain gauge roller 76 so as to permit the strain gauge roller 76 to operate properly and optimally.

In accordance with the particular principles and teachings of the present invention, a second, substantially vertically oriented outfeed idler roller 80, the significance of which will be explained more fully shortly hereinafter, is mounted upon the extreme right end portion of the base plate 12, as viewed in FIG. 3, by means of a fourth laterally extending support bracket 82 which is secured to base plate 12 by means of suitable bolt fasteners, not shown. Lastly, as best appreciated from FIGS. 1 and 3, a third, substantially vertically oriented infeed idler roller 84 is provided along the wrapping film flow path at a position interposed between the wrapping film supply roll 16 and the first relatively small stretch roller or tension roll 44, and in order to rotatably support the opposite ends of the third infeed idler roller 84, fifth and sixth support brackets 86,88 are respectively mounted, by means of suitable bolt fasteners, not shown, upon the base plate 12 and the steel sheet form or housing 22. It can therefore be readily appreciated that when a new or fresh wrapping film supply roll 16 has been installed upon the stretch head 10, the leading end of the wrapping film 18 is withdrawn from the supply roll 16, routed around the idler roller 84, and conducted toward the tension rolls or stretch rollers 44,46. In view of the fact that the upper ends of the tension rolls or stretch rollers 44,46 are respectively rotatably mounted within the mounting or support brackets 64,70 which are separate and independent from each other so as not to be connected to each other, such as, for example, by means of upper frame members or the like, the upper end of the stretch head 10, within the region or vicinity of the tension rolls or stretch rollers 44,46 is effectively open.

In view of the additional fact that the tension rolls or stretch rollers 44,46 are laterally spaced from each other, the leading end of the wrapping film 18 may be partially routed around the small tension roll or stretch roller 44, subsequently readily and easily inserted between the tension rolls or stretch rollers 44,46 in a substantially vertically downward mode within the space defined between the tension rolls or stretch rollers 44,46 and in a direction parallel to the longitudinal axes of the tension rolls or stretch rollers 44,46, and routed around the large tension roll or stretch roller 46 so as to be conducted further downstream toward the strain gauge roller 76 and first outfeed idler roller 78. As can therefore be appreciated still further, in view of the additional fact that the upper region of the stretch head 10, particularly within the vicinity of the tension rolls or stretch rollers 44,46 is open and not closed or covered by means of an upper frame member or the like, the wrapping film 18 can be inserted between and routed around the tension rolls or stretch rollers 44,46 in a substantially vertically downward mode or axial direction so as to effectively eliminate awkward, difficult, tedious, and time-consuming wrapping film threading operations.

It has been noted hereinbefore that in accordance with the principles and teachings of the present invention, the second outfeed idler roller 80 has been mounted upon the extreme right end portion of the base plate 12 as viewed within, and as may best be appreciated from, FIG. 3. As may best be additionally appreciated or understood from FIGS. 2 and 3, and as has been noted hereinbefore, the vertically oriented downright or support mast structure 32, upon which the entire stretch head 10 is movable in a vertically reciprocable manner attendant a film wrapping operation, is in fact disposed so as to have a truly vertical orientation. Accordingly, it can therefore be appreciated further that the entire stretch head 10, as illustrated within FIG. 2, will not be disposed horizontally as shown in FIG. 2, but, in reality, when the stretch head 10 is movably mounted upon the vertical downright or mast structure 32, whereby the vertical axis of, for example, the sheet form or housing 22 is disposed truly vertical, the base plate 12 will be disposed at an inclined orientation with respect to the horizontal so as to extend from the upper left toward the lower right. In this manner, the left end portion of the base plate 12, upon which the wrapping film supply roll 16 is disposed, will be disposed at a higher elevation than the right end portion of the base plate 12 upon which the second outfeed idler roller 80 is disposed.

Therefore, in accordance with the unique and novel principles and teachings of the present invention, when the stretch head 10 is moved vertically downwardly to its lowermost position, as permitted or dictated by means of the slotted rails 28 of the support bracket 24 portion of the main support frame 20 riding or moving along the flanged ends of the downright or mast structure 32, the second outfeed idler roller 80 will be disposed at an elevational level which is below that of the main support frame 20 so as to in fact enable the wrapping film 18, which is effectively being dispensed or withdrawn from the second outfeed idler roller 80, to be disposed within the lowermost regions of the support pallet, not shown, upon which the palletized load, undergoing a film wrapping operation, is disposed. In particular, conventional support pallets usually have a height or depth dimension of, for example, five inches (5.00"), and it has been determined, in accordance with the principles and teachings of the present invention, that the aforenoted elevational disposition of the second outfeed idler roller 80 enables the wrapping film to be wrapped around the palletized load in such a manner as to wrap, envelop, or overlap the upper three inches (3.00") of the support pallet itself, or in other words, to be capable of being wrapped around the palletized load at an elevational level which is only two inches (2.00") above the floor or other support platform, not shown, upon which the support pallet is disposed.

In accordance with a last significant feature characteristic of the present invention, it is noted still further that, unlike the strain gauge roller 76 and the first outfeed idler roller 78, the second outfeed idler roller 80 has a sleeve member 90 wrapped around the external periphery thereof. The sleeve member 90 may comprise any suitable rubberized material, or any other similar material, which causes the wrapping film 18 to effectively adhere thereto in such a manner that while relative dispensing or conveyance movement of the wrapping film 18, along the wrapping film flow path toward the palletized load, not shown, is permitted, transverse movement along the second outfeed idler roller 80, in a direction parallel to the rotary axis of the second outfeed idler roller 80, is effectively prevented. In this manner, the wrapping film 18 cannot undergo or experience any slippage with respect to the second outfeed idler roller 80, along the external periphery and in the axial direction thereof, whereby the wrapping film 18 can be positioned with respect to the palletized load, not shown, as desired in accordance with film wrapping techniques attendant the film wrapping operation. It is noted further that the sleeve member 90 may comprise several different forms or embodiments, such as, for example, a onepiece tubular sleeve structure, a sheet member formed or rolled into a sleeve member and subsequently secured in such state, or strip material similar to the wrapping material conventionally employed to wrap the handle portion of a tennis racquet. In either case, the sleeve member 90 serves the aforenoted purpose of properly positioning and orienting the wrapping film 18 with respect to the palletized load.

Thus, it may be seen that in accordance with the principles and teachings of the present invention, there has been provided, in addition to the conventionally employed strain gauge roller and the first outfeed idler roller disposed adjacent to the strain gauge roller for effectively ensuring a 90° flow path of the wrapping film around the strain gauge roller, a second outfeed idler roller which is located upon the extreme end portion of the base plate of the stretch head which is disposed opposite the wrapping film supply roll. Due to the inclined orientation of the stretch head upon the vertically oriented downright or mast structure, the second outfeed idler roller will be disposed at the lowest possible elevational level so as to enable the dispensed or withdrawn wrapping film to reach the lowermost regions of the palletized load and to in fact partially envelop the upper portion of the support pallet itself. In addition, the second outfeed idler roller is provided with a sleeve member which effectively causes the wrapping film to adhere thereto in a non-slip manner such that longitudinal dispensing of the wrapping film is permitted, however, transverse slippage of the wrapping film along the longitudinal axis of the second outfeed idler roller is effectively prevented. In this manner, proper disposition and orientation of the wrapping film toward and with respect to the palletized load is achieved.

Obviously, many variations and modifications of the present invention are possible in light of the above teachings. It is therefore to be understood that within the scope of the appended claims, the present invention may be practiced otherwise than as specifically described herein.

What is claimed as new and desired to be protected by Letters Patent of the United States of America, is:

1. A wrapping machine stretch head for use in connection with the packaging of a load within wrapping film, comprising:

a substantially vertically oriented downright;

a base plate inclined with respect to a substantially horizontal plane such that a first end of said base plate is disposed at a higher elevation than a second end of said base plate;

a supply roll of wrapping film rotatably mounted upon said first end of said base plate;

a carriage assembly, upon which said base plate is fixedly mounted, vertically movable upon said substantially vertically oriented downright between raised and lowered positions so as to enable wrapping film to be wrapped around the load throughout the vertical extent of the load;

a first tension roller having first and second ends defining a longitudinal roller axis therebetween, and wherein said first end of said first tension roller is rotatably mounted upon said base plate;

a second tension roller having first and second ends defining a longitudinal roller axis therebetween, said first end of said second tension roller is rotatably mounted upon said base plate, and wherein said second tension roller is adapted to operatively cooperate with said first tension roller so as to define with said first tension roller a space therebetween through which a portion of said wrapping film, when withdrawn from said supply roll of wrapping film, can pass whereby a predetermined amount of tension is developed within said wrapping film when said wrapping film is withdrawn from said supply roll of wrapping film and routed around said first and second tension rollers so as to be conveyed in a predetermined direction toward the load to be wrapped;

motor drive means operatively connected to first and second tension rollers for rotatably driving said first and second tension rollers;

a strain gauge roller rotatably mounted upon said second end of said base plate, and disposed downstream from said second tension roller, as considered in said predetermined direction of conveyance of said wrapping film from said supply roll of wrapping film to the load, for sensing said amount of tension developed within said wrapping film and for controlling said motor drive means in accordance with said sensed amount of tension;

a first idler roller rotatably mounted upon said second end of said base plate and disposed downstream from said strain gauge roller, as considered in said predetermined direction of conveyance of said wrapping film from said supply roll of wrapping film to the load, said wrapping film being routed around an external surface portion of said strain gauge roller which faces away from said supply roll of wrapping film, and around an external surface portion of said first idler roller which faces toward said supply roll of wrapping film, such that the outfeed flow path portion of said wrapping film which extends between said strain gauge roller and said first idler roller is disposed at an angle of approximately 90° with respect to the infeed flow path portion of said wrapping film which extends between said second tension roller and said strain gauge roller; and a second idler roller rotatably mounted upon said second end of said base plate and disposed remotely downstream from said first idler roller, as considered in said predetermined direction of conveyance of said wrapping film from said supply roll of wrapping film to the load, such that said wrapping film is routed around an external surface portion of said second idler roller which faces away from said supply roll of wrapping film, and the portion of said wrapping film which extends between said first and second idler rollers is disposed at a substantially obtuse angle with respect to said portion of said wrapping film which extends between said strain gauge roller and said first idler roller, whereby said second idler roller will be disposed at the lowest elevational level upon said carriage assembly, due to said inclination of said base plate with respect to said horizontal plane, such that when said wrapping film is conveyed from said second idler roller to the load during a load wrapping operation, said wrapping film will be able to be applied to the lowermost elevational levels of the wrapped load.

2. The wrapping machine stretch head as set forth in claim 1, wherein said motor drive means comprises:

a motor;

a plurality of sprocket wheels wherein one of said plurality of sprocket wheels is operatively connected to said motor so as to be driven thereby; and a sprocket wheel chain operatively interconnecting other ones of said plurality of sprocket wheels to said one of said sprocket wheels such that said other ones of said plurality of sprocket wheels can be driven by said one of said plurality of sprocket wheels and said sprocket wheel chain.

3. The wrapping machine stretch head as set forth in claim 1, wherein:

said space, defined between said first and second tension rollers and through which said portion of said wrapping film passes, withdrawn from said supply roll of wrapping film and being conveyed toward the wrapped load, is disposed within a first vertical plane;

first securing means, extending only substantially within a second plane which is substantially parallel to said first plane within which said space, defined between said first and second tension rollers, is disposed, is provided for rotatably securing said second end of said first tension roller; and second securing means, extending only substantially within a third plane which is substantially parallel to said first plane within which said space, defined between said first and second tension rollers, is disposed, and which is also substantially parallel to said second plane within which said first securing means is disposed, is provided for rotatably securing said second end of said second tension roller and for cooperating with said first securing means in defining a channel, between said first and second securing means, which is open upon opposite sides of said space defined between said first and second tension rollers such that an axially open space is defined between said second ends of said first and second tension rollers and between said first and second securing means so as to permit said wrapping film, withdrawn from said supply roll of wrapping film, to be inserted into said channel defined between said first and second securing means, and into said space defined between said first and second tension rollers, in an axial direction which is substantially parallel to said longitudinal axes of said first and second tension rollers, which is substantially parallel to said second and third planes, and which extends from an axial position commencing beyond said second ends of said first and second tension rollers, through said space defined between said first and second tension rollers, and toward said first ends of said first and second tension rollers rotatably mounted upon said base plate.

4. The wrapping machine stretch head as set forth in claim 1, wherein:

said first tension roller is disposed upstream of said second tension roller, as considered in said predetermined direction of conveyance of said wrapping film from said supply roll of wrapping film to the load, and has a smaller diametrical extent than the diametrical extent of said second tension roller; and said plurality of sprocket wheels comprises first and second sprocket wheels operatively connected respectively to said first and second tension rollers, wherein said first sprocket wheel, operatively connected to said first tension roller, has a larger diametrical extent than said second sprocket wheel, operatively connected to said second tension roller, so as to develop said predetermined amount of tension within said wrapping film.

5. A wrapping machine stretch head for use in connection with the packaging of a load within wrapping film, comprising:

a substantially vertically oriented downright;

a base plate inclined with respect to a substantially horizontal plane such that a first end of said base plate is disposed at a higher elevation than a second end of said base plate;

a supply roll of wrapping film rotatably mounted upon said first end of said base plate;

a carriage assembly, upon which said base plate is fixedly mounted, vertically movable upon said substantially vertically oriented downright between raised and lowered positions so as to enable wrapping film to be wrapped around the load throughout the vertical extent of the load;

a first tension roller having first and second ends defining a longitudinal roller axis therebetween, and wherein said first end of said first tension roller is rotatably mounted upon said base plate;

a second tension roller having first and second ends defining a longitudinal roller axis therebetween, said first end of said second tension roller is rotatably mounted upon said base plate, and wherein said second tension roller is adapted to operatively cooperate with said first tension roller so as to define with said first tension roller a space therebetween through which a portion of said wrapping film, when withdrawn from said supply roll of wrapping film, can pass whereby a predetermined amount of tension is developed within said wrapping film when said wrapping film is withdrawn from said supply roll of wrapping film and routed around said first and second tension rollers so as to be conveyed in a predetermined direction toward the load to be wrapped;

motor drive means operatively connected to first and second tension rollers for rotatably driving said first and second tension rollers;

a strain gauge roller rotatably mounted upon said second end of said base plate, and disposed downstream from said second tension roller, as considered in said predetermined direction of conveyance of said wrapping film from said supply roll of wrapping film to the load, for sensing said amount of tension developed within said wrapping film and for controlling said motor drive means in accordance with said sensed amount of tension;

a first idler roller rotatably mounted upon said second end of said base plate and disposed downstream from said strain gauge roller, as considered in said predetermined direction of conveyance of said wrapping film from said supply roll of wrapping film to the load, said wrapping film being routed around an external surface portion of said strain gauge roller which faces away from said supply roll of wrapping film, and around an external surface portion of said first idler roller which faces toward said supply roll of wrapping film, such that the outfeed flow path portion of said wrapping film which extends between said strain gauge roller and said first idler roller is disposed at an angle of approximately 90° with respect to the infeed flow path portion of said wrapping film which extends between said second tension roller and said strain gauge roller; and a second idler roller rotatably mounted upon said second end of said base plate and disposed remotely downstream from said first idler roller, as considered in said predetermined direction of conveyance of said wrapping film from said supply roll of wrapping film to the load, such that said wrapping film is routed around an external surface portion of said second idler roller which faces away from said supply roll of wrapping film, and the portion of said wrapping film which extends between said first and second idler rollers is disposed at a substantially obtuse angle with respect to said portion of said wrapping film which extends between said strain gauge roller and said first idler roller, whereby said second idler roller will be disposed at the lowest elevational level upon said carriage assembly, due to said inclination of said base plate with respect to said horizontal plane, such that when said wrapping film is conveyed from said second idler roller to the load during a load wrapping operation, said wrapping film will be able to be applied to the lowermost elevational levels of the wrapped load;

said second idler roller having a sleeve member, disposed around an external peripheral portion thereof, for effectively causing said wrapping film to adhere thereto in such a manner that while relative conveyance of said wrapping film, from said supply roll of wrapping film toward the load is permitted, transverse movement along said second idler roller in a direction parallel to the longitudinal rotational axis of said second idler roller is effectively prevented so as to prevent said wrapping film from undergoing any slippage with respect to said second idler roller.

6. The wrapping machine stretch head as set forth in claim 5, wherein:

said sleeve member is fabricated from a rubberized material.

7. The wrapping machine stretch head as set forth in claim 5, wherein:

said sleeve member comprises a member selected from the group comprising a one-piece tubular sleeve structure, a flat sheet member formed into a tubular sleeve structure and subsequently secured in such state, and strip material formed into a tubular sleeve structure.

8. The wrapping machine stretch head as set forth in claim 5, wherein said motor drive means comprises:

a motor;

a plurality of sprocket wheels wherein one of said plurality of sprocket wheels is operatively connected to said motor so as to be driven thereby; and a sprocket wheel chain operatively interconnecting other ones of said plurality of sprocket wheels to said one of said sprocket wheels such that said other ones of said plurality of sprocket wheels can be driven by said one of said plurality of sprocket wheels and said sprocket wheel chain.

9. The wrapping machine stretch head as set forth in claim 5, wherein:

said space, defined between said first and second tension rollers and through which said portion of said wrapping film passes, withdrawn from said supply roll of wrapping film and being conveyed toward the wrapped load, is disposed within a first vertical plane;

first securing means, extending only substantially within a second plane which is substantially parallel to said first plane within which said space, defined between said first and second tension rollers, is disposed, is provided for rotatably securing said second end of said first tension roller; and second securing means, extending only substantially within a third plane which is substantially parallel to said first plane within which said space, defined between said first and second tension rollers, is disposed, and which is also substantially parallel to said second plane within which said first securing means is disposed, is provided for rotatably securing said second end of said second tension roller and for cooperating with said first securing means in defining a channel, between said first and second securing means, which is open upon opposite sides of said space defined between said first and second tension rollers such that an axially open space is defined between said second ends of said first and second tension rollers and between said first and second securing means so as to permit said wrapping film, withdrawn from said supply roll of wrapping film, to be inserted into said channel defined between said first and second securing means, and into said space defined between said first and second tension rollers, in an axial direction which is substantially parallel to said longitudinal axes of said first and second tension rollers, which is substantially parallel to said second and third planes, and which extends from an axial position commencing beyond said second ends of said first and second tension rollers, through said space defined between said first and second tension rollers, and toward said first ends of said first and second tension rollers rotatably mounted upon said base plate.

10. The wrapping machine stretch head as set forth in claim 5, wherein:

said first tension roller is disposed upstream of said second tension roller, as considered in said predetermined direction of conveyance of said wrapping film from said supply roll of wrapping film to the load, and has a smaller diametrical extent than the diametrical extent of said second tension roller; and said plurality of sprocket wheels comprises first and second sprocket wheels operatively connected respectively to said first and second tension rollers, wherein said first sprocket wheel, operatively connected to said first tension roller, has a larger diametrical extent than said second sprocket wheel, operatively connected to said second tension roller, so as to develop said predetermined amount of tension within said wrapping film.

* * * * *